United States Patent [19]

Spadini et al.

[11] Patent Number: 4,490,271

[45] Date of Patent: Dec. 25, 1984

[54] DETERGENT COMPOSITIONS CONTAINING POLYETHYLENE GLYCOL AND POLYACRYLATE

[75] Inventors: Gianfranco L. Spadini, Wyoming; Antoinette L. Larrabee; Don K. K. Liu, both of Cincinnati, all of Ohio

[73] Assignee: The Procter & Gamble Company, Cincinnati, Ohio

[21] Appl. No.: 509,884

[22] Filed: Jun. 30, 1983

[51] Int. Cl.[3] ..... C11D 3/37; C11D 3/08; C11D 17/06

[52] U.S. Cl. ..... 252/174.23; 252/140; 252/174.21; 252/174.24; 252/174.25; 252/DIG. 2; 252/DIG. 14

[58] Field of Search ..... 252/DIG. 2, DIG. 14, 252/174.21, 174.24, 140, 174.25

[56] References Cited

U.S. PATENT DOCUMENTS

| | | | |
|---|---|---|---|
| 2,806,001 | 9/1957 | Fong | 252/550 |
| 3,922,230 | 11/1975 | Lamberti et al. | 252/89 |
| 3,962,132 | 6/1976 | Haschke et al. | 252/430 |
| 4,072,621 | 2/1978 | Rose | 252/89 R |
| 4,095,035 | 6/1978 | Lamberti et al. | 560/180 |
| 4,132,735 | 1/1979 | Lamberti et al. | 562/582 |
| 4,325,829 | 4/1982 | Duggleby | 252/109 |
| 4,379,080 | 4/1983 | Murphy | 252/526 |

FOREIGN PATENT DOCUMENTS

| | | |
|---|---|---|
| 56332 | 7/1982 | European Pat. Off. . |
| 1460893 | 1/1977 | United Kingdom . |
| 1551239 | 8/1979 | United Kingdom . |
| 2097419A | 11/1982 | United Kingdom . |

*Primary Examiner*—John E. Kittle
*Assistant Examiner*—Mukund J. Shah
*Attorney, Agent, or Firm*—Jacobus C. Rasser; Janice L. Fowler; Steven J. Goldstein

[57] ABSTRACT

Detergent compositions comprising a mixture of polyethylene glycol and polyacrylate of specified molecular weight are disclosed.

16 Claims, No Drawings

DETERGENT COMPOSITIONS CONTAINING POLYETHYLENE GLYCOL AND POLYACRYLATE

TECHNICAL FIELD

The present invention relates to detergent compositions containing an organic surfactant, a non-phosphate detergent builder, a polyethylene glycol having a weight average molecular weight of from about 1,000 to about 50,000, and a polyacrylate polymer having a weight average molecular weight of from about 1,000 to about 20,000.

BACKGROUND ART

U.S. Pat. No. 4,072,621, Rose, issued Feb. 7, 1978, discloses the addition of a water-soluble copolymer of a vinyl compound and maleic anhydride to granular detergents containing aluminosilicate builders.

British Pat. No. 2,048,841, Burzlo, published Dec. 17, 1980, discloses the use of polymeric acrylamides to stabilize aqueous suspensions of zeolites. The suspensions are said to be suitable for spray-drying to obtain detergent compositions.

U.S. Pat. No. 3,933,673, Davies, issued Jan. 20, 1976, describes the use of partial alkali metal salts of homo- or copolymers of unsaturated aliphatic mono- or polycarboxylic acids as builders which provide improved storage properties.

U.S. Pat. No. 3,794,605, Diehl, issued Feb. 26, 1974, relates to the use of from 0.1% to 20% of a mixture of salts of cellulose sulfate esters and copolymers of a vinyl compound with maleic anhydride to provide whiteness maintenance benefits to detergent compositions.

U.S. Pat. No. 3,922,230, Lamberti et al, issued Nov. 25, 1975, discloses detergent compositions containing oligomeric polyacrylates.

U.S. Pat. No. 4,031,022, Vogt et al, issued June 21, 1977, discloses detergent compositions containing copolymers of alphahydroxyacrylic acid and acrylic acid.

British Pat. No. 1,333,915, published Oct. 17, 1973, discloses that polyacrylic acids of molecular weight greater than 1000 and having from 5–55% of its carboxyl groups neutralized as the sodium salt are free-flowing powders useful as detergent builders.

British Pat. No. 1,380,402, Pritchard et al, published Jan. 15, 1975, relates to the addition of low levels of reactive and non-reactive polymers to provide free-flowing granular detergents containing nonionic surfactants.

U.S. Pat. No. 4,379,080, Murphy, issued Apr. 5, 1983, discloses the use of film forming polymers in granular detergent compositions to improve the free-flowing characteristics and solubility of the granules. It is disclosed that the film forming polymer may be a polyacrylate which has a molecular weight of from about 3000 to about 100,000.

SUMMARY OF THE INVENTION

The present invention encompasses a granular detergent composition comprising:

(a) from about 5% to about 50% by weight of an organic surfactant selected from the group consisting of anionic, nonionic, zwitterionic, ampholytic and cationic surfactants, and mixtures thereof;

(b) from about 5% to about 80% by weight of a non-phosphorous detergent builder;

(c) from about 1% to about 20% of a mixture of a polyethylene glycol and a polyacrylate said mixture having a polyethylene glycol:polyacrylate weight ratio of from about 1:10 to about 10:1, said polyethylene glycol having a weight average molecular weight of from about 1,000 to about 50,000, and said polyacrylate having a weight average molecular weight of from about 1,000 to about 20,000.

DETAILED DESCRIPTION OF THE INVENTION

The detergent compositions of the present invention contain an organic surfactant, a water-soluble non-phosphorus detergent builder, and a mixture of a polyacrylate polymer of selected molecular weight and a polyethylene glycol of selected molecular weight. The polyacrylate/polyethylene glycol mixtures herein provide a surprising boost to the removal of clay soils, even at low levels which do not provide substantial builder capacity.

The compositions of the present invention can be prepared by drying an aqueous slurry comprising the components or by agglomeration, or by mixing the ingredients to an aqueous solution or suspension. The effect is obtained regardless of the method of preparation.

ORGANIC SURFACTANT

The detergent compositions herein contain from about 5% to about 50% by weight of an organic surfactant selected from the group consisting of anionic, nonionic, zwitterionic, ampholytic and cationic surfactants, and mixtures thereof. The surfactant preferably represents from about 10% to about 30% by weight of the detergent composition. Surfactants useful herein are listed in U.S. Pat. No. 3,664,961, Norris, issued May 23, 1972, and in U.S. Pat. No. 3,919,678, Laughlin, et al, issued Dec. 30, 1975, both incorporated herein by reference. Useful cationic surfactants also include those described in U.S. Pat. No. 4,222,905, Cockrell, issued Sept. 16, 1980, and in U.S. Pat. No. 4,239,659, Murphy, issued Dec. 16, 1980, both incorporated herein by reference.

Water-soluble salts of the higher fatty acids, i.e., "soaps", are useful anionic surfactants in the compositions herein. This includes alkali metal soaps such as the sodium, potassium, ammonium, and substituted ammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and substituted ammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_8$–$C_{18}$ carbon atoms) such as those produced by reducing the glycerides of tallow or coconut oil; and the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383 both of which are incorporated herein by reference. Especially valuable are linear straight chain alkylbenzene sulfonates in which the average number of carbon atoms in the alkyl group is from about 11 to 13, abbreviated as $C_{11-13}$LAS.

Other anionic surfactants suitable for use herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and from about 8 to about 12 carbon atoms in the alkyl group; and sodium or potassium salts of alkyl ethylene oxide ether sulfates containing from about 1 to about 10 units of ethylene oxide per molecule and from about 10 to about 20 carbon atoms in the alkyl group.

Other useful anionic surfactants include the water-soluble salts of esters of alpha-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; water-soluble salts of olefin sulfonates containing from about 12 to 24 carbon atoms; and beta-alkyloxy alkane sulfonates containing from about 1 to 3 carbon atoms in the alkyl group and from about 8 to 20 carbon atoms in the alkane moiety.

Water-soluble nonionic surfactants are also useful in the compositions of the invention. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 15 carbon atoms, in either a straight chain or branched chain configuration, with from about 3 to 12 moles of ethylene oxide per mole of alkyl phenol.

Preferred nonionics are the water-soluble condensation products of aliphatic alcohols containing from 8 to 22 carbon atoms, in either straight chain or branched configuration, with from 3 to 12 moles of ethylene oxide per mole of alcohol. Particularly preferred are the condensation products of alcohols having an alkyl group containing from about 9 to 15 carbon atoms with from about 4 to 8 moles of ethylene oxide per mole of alcohol.

Semi-polar nonionic surfactants useful herein include water-soluble amine oxides containing one alkyl moiety of from about 10 to 18 carbon atoms and two moieties selected from the group consisting of alkyl groups and hydroxyalkyl groups containing from 1 to 3 carbon atoms; water-soluble phosphine oxides containing one alkyl moiety of about 10 to 18 carbon atoms and two moieties selected from the group consisting of alkyl groups and hydroxyalkyl groups containing from 1 to about 3 carbon atoms; and water-soluble sulfoxides containing one alkyl moiety of from about 10 to 18 carbon atoms and a moiety selected from the group consisting of alkyl and hydroxyalkyl moieties of from 1 to about 3 carbon atoms.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic quaternary ammonium, phosphonium, and sulfonium compounds in which one of the aliphatic substituents contains from about 8 to about 18 carbon atoms.

Particularly preferred surfactants herein are anionic surfactants selected from the group consisting of the alkali metal salts of $C_{11-13}$ alkylbenzene sulfonates, $C_{14-18}$ alkyl sulfates, $C_{14-18}$ alkyl linear polyethoxy sulfates containing from about 1 to about 4 moles of ethylene oxide, and mixtures thereof.

THE NON-PHOSPHOROUS DETERGENT BUILDER

The compositions of the present invention also contain from about 5% to about 80%, preferably from about 10% to about 70%, and most preferably from about 15% to about 60%, by weight of a non-phosphorous detergent builder. The non-phosphorous detergent builder can be either organic or inorganic in nature.

Non-phosphorous detergent builders are generally selected from the various water-soluble, alkali metal, ammonium or substituted ammonium carbonates, and silicates. Preferred are the alkali metal, especially sodium, salts of the above. However, the present compositions preferably contain less than about 6%, more preferably less than about 4%, by weight of silicate materials for optimum granule solubility.

Specific examples of non-phosphorus, inorganic builders are sodium and potassium carbonate, bicarbonate, sesquicarbonate, tetraborate decahydrate, and silicate having a molar ratio of $SiO_2$ to alkali metal oxide of from about 0.5 to about 4.0, preferably from about 1.0 to about 2.4.

An especially preferred detergency builder is crystalline aluminosilicate ion exchange material of the formula $$Na_z[(AlO_2)_z(SiO_2)_y]xH_2O$$

wherein z and y are at least about 6, the molar ratio of z to y is from about 1.0 to about 0.5 and x is from about 10 to about 264. Amorphous hydrated aluminosilicate materials useful herein have the empirical formula $$M_z(zAlO_2.ySiO_2)$$

wherein M is sodium, potassium, ammonium or substituted ammonium, z is from about 0.5 to about 2 and y is 1, said material having a magnesium ion exchange capacity of at least about 50 milligram equivalents of $CaCO_3$ hardness per gram of anhydrous aluminosilicate.

The aluminosilicate ion exchange builder materials herein are in hydrated form and contain from about 10% to about 28% of water by weight if crystalline, and potentially even higher amounts of water if amorphous. Highly preferred crystalline aluminosilicate ion exchange materials contain from about 18% to about 22% water in their crystal matrix. The crystalline aluminosilicate ion exchange materials are further characterized by a particle size diameter of from about 0.1 micron to about 10 microns. Amorphous materials are often smaller, e.g., down to less than about 0.01 micron. Preferred ion exchange materials have a particle size diameter of from about 0.2 micron to about 4 microns. The term "particle size diameter" herein represents the average particle size diameter of a given ion exchange material as determined by conventional analytical techniques such as, for example, microscopic determination utilizing a scanning electron microscope. The crystalline aluminosilicate ion exchange materials herein are usually further characterized by their calcium ion exchange capacity, which is at least about 200 mg. equivalent of $CaCO_3$ water hardness/g. of aluminosilicate, calculated on an anhydrous basis, and which generally is in the range of from about 300 mg. eq./g. to about 352 mg. eq./g. The aluminosilicate ion exchange materials herein are still further characterized by their calcium ion exchange rate which is at least about 2 grains $Ca^{++}$/gallon/minute/gram/gallon of aluminosilicate (anhydrous basis), and generally lies within the range of from about 2 grains/gallon/minute/gram/gallon to about 6 grains/gallon/minute/gram/gallon, based on calcium ion hardness. Optimum aluminosilicate for builder purposes exhibit a calcium ion exchange rate of at least about 4 grains/gallon/minute/gram/gallon.

The amorphous aluminosilicate ion exchange materials usually have a $Mg^{++}$ exchange capacity of at least about 50 mg. eq. $CaCO_3$/g. (12 mg. $Mg^{++}$/g.) and a $Mg^{++}$ exchange rate of at least about 1 grain/gallon/minute/gram/gallon. Amorphous materials do not exhibit an observable diffraction pattern when examined by Cu radiation (1.54 Angstrom Units).

Aluminosilicate ion exchange materials useful in the practice of this invention are commercially available. The aluminosilicates useful in this invention can be crystalline or amorphous in structure and can be naturally-occurring aluminosilicates or synthetically derived. A method for producing aluminosilicate ion exchange materials is discussed in U.S. Pat. No. 3,985,669, Krummel et al, issued Oct. 12, 1976, incorporated herein by reference. Preferred synthetic crystalline aluminosilicate ion exchange materials useful herein are available under the designations Zeolite A, Zeolite B, and Zeolite X. In an especially preferred embodiment, the crystalline aluminosilicate ion exchange material in Zeolite A and has the formula $$Na_{12}[AlO_2)_{12}\cdot(SiO_2)_{12}].xH_2O$$

wherein x is from about 20 to about 30, especially about 27.

Water-soluble, non-phosphorus organic builders useful herein include the various alkali metal, ammonium and substituted ammonium, carboxylates, non-polymeric polycarboxylates and polyhydroxysulfonates. Examples of non-polymeric polycarboxylate builders are the sodium, potassium, lithium, ammonium and substituted ammonium salts of ethylenediaminetetraacetic acid, nitrilotriacetic acid, oxydisuccinic acid, mellitic acid, benzene polycarboxylic acids, and citric acid. The compositions of this invention only contain the limited amount of polyacrylate defined hereinafter.

Other useful builders herein are sodium and potassium carboxymethyloxymalonate, carboxymethyloxysuccinate, cis-cyclohexanehexacarboxylate, cis-cyclopentanetetracarboxylate, and phloroglucinol trisulfonate.

Other suitable non-polymeric polycarboxylates are the polyacetal carboxylates described in U.S. Pat. No. 4,144,226, issued Mar. 13, 1979 to Crutchfield, et al., and U.S. Pat. No. 4,246,495, issued Mar. 27, 1979 to Crutchfield, et al., both incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a surfactant.

Other detergency builder materials useful herein are the "seeded builder" compositions disclosed in Belgian Pat. No. 798,856, issued Oct. 29, 1973, incorporated herein by reference. Specific examples of such seeded builder mixtures are: 3.1 wt. mixtures of sodium carbonate and calcium carbonate having 5 micron particle diameter; 2.7:1 wt. mixtures of sodium sesquicarbonate and calcium carbonate having a particle diameter of 0.5 microns; 20:1 wt. mixtures of sodium sesquicarbonate and calcium hydroxide having a particle diameter of 0.01 micron; and a 3:3:1 wt. mixture of sodium carbonate, sodium aluminate and calcium oxide having a particle diameter of 5 microns.

Preferably the builder is selected from the group consisting of zeolites, especially Zeolite A; carbonates, especially sodium carbonate; and citrates, especially sodium citrate.

Soaps, as described hereinbefore, can also act as builders depending upon the pH of the wash solution, the insolubility of the calcium and/or magnesium soaps, and the presence of other builders and soap dispersants.

The compositions herein preferably contain as part of the non-phosphorous builder from about 0% to about 6%, preferably from about 0.5% to about 5%, and most preferably from about 1% to about 4%, by weight of an alkali metal silicate having a molar ratio of $SiO_2$ to alkali metal oxide of from about 1.0 to about 3.2, 2.4. Sodium silicate, particularly one having a molar ratio of from about 1.8 to about 2.2, is preferred.

The alkali metal silicates can be purchased in either liquid or granular form. Silicate slurries can conveniently be used to avoid having to dissolve the dried form in the aqueous slurry (e.g., crutcher mix) of the components herein.

POLYETHYLENE GLYCOL/POLYACRYLATE

The compositions of the present invention contain from about 1% to about 20%, preferably from about 1.5% to about 10% of a mixture of a polyethylene glycol and a polyacrylate. The polyethylene glycol and the polyacrylate are present in a weight ratio of from about 1:10 to about 10:1, preferably from about 1:3 to about 3:1. The polyethylene glycol has a weight average molecular weight of from about 1,000 to about 50,000, preferably from about 5,000 to about 20,000. The polyacrylate has a weight average molecular weight of from about 1,000 to about 20,000, preferably from about 3,000 to about 15,000, and more preferably from about 3,000 to about 8,000.

Optimum solubility of the polyacrylate is obtained when it is in the form of an at least partially neutralized alkali metal, ammonium or substituted ammonium (e.g., mono-, di- or triethanol ammonium) salt. The alkali metal, especially sodium, salts are most preferred.

Suitable polyacrylates herein are the at least partially neutralized salts of polymers of acrylic acid. One can also use copolymers formed with small amounts of other copolymerisable monomers. The percentage by weight of the polyacrylate units which is derived from acrylic acid is preferably greater than about 80%. Suitable copolymerisable monomers include, for example, methacrylic acid, hydroxyacrylic acid, vinyl chloride, vinyl alcohol, furan, acrylonitrile, methacrylonitrile, vinyl acetate, methyl acrylate, methyl methacrylate, styrene, alpha-methylstyrene, vinyl methyl ether, vinyl ethyl ether, vinyl propyl ether, acrylamide, ethylene, propylene and 3-butenoic acid. Mixtures of these polymers can also be used.

Preferred copolymers of the above group contain at least about 90% by weight of units derived from the acrylic acid. Preferably essentially all of the polymer is derived from acrylic acid. Particularly preferred is sodium polyacrylate, especially when it has an average molecular weight of from about 3,000 to about 8,000.

Other ingredients commonly used in granular detergents can be included in the compositions of the present invention. These include color speckles, bleaching agents and bleach activators, suds boosters or suds suppressors, anti-tarnish and anti-corrosion agents, soil release agents, dyes, fillers, optical brighteners, germicides, non-builder alkalinity sources, enzymes, enzyme-stabilizing agents, and perfumes.

The following non-limiting examples illustrate the detergent compositions of the present invention.

All percentages, parts, and ratios used herein are by weight unless otherwise specified.

EXAMPLE I

| Component | Wt. % |
|---|---|
| $NaC_{13}$ alkylbenzene sulfonate | 9.25 |
| $NaC_{14}$ alkyl sulfate ($C_{14-15}$ AS) | 9.25 |
| Na Zeolite A, hydrated (2-3) | 23.8 |
| $Na_2CO_3$ | 13.1 |
| Na silicate (1.6) | 1.0 |
| $Na_2SO_4$, water, minors, Na polyacrylate and polyethylene glycol as indicated | Balance |

The above compositions with the indicated amounts of sodium polyacrylate (MW 4500) and polyethylene glycol (MW 8000) were tested in automatic miniwashers with assorted soils and stains present including the particulate soil (clay) that defines the "Cleaning Index". The "Cleaning Index" is obtained by finding the panel score grades for each product using a scale in which 0 means "There is no difference"; 1 means "I think I see a difference"; 2 means "I see a difference"; and 3 means "I see a big difference". The control product contains no polyacrylate or polyethylene glycol and the best performing product is set at 100 with all other grades being ranked as a percent of the difference.

| Test conditions: 95° F. (35° C.); 7 grains per gallon | Cleaning Index | LSD |
|---|---|---|
| Cotton Fabric Polymer | | |
| None | 0 | 23 |
| 2% PEG-8000 | 46 | 23 |
| 1% PEG-8000/1% PA-4500 | 75 | 23 |
| 0.6% PEG-8000/1.4% PA-4500 | 100 | 23 |
| 2% PA-4500 | 63 | 23 |
| Polycotton Fabric Polymer | | |
| None | 0 | 32 |
| 2% PEG-8000 | 68 | 32 |
| 1% PEG-8000/1% PA-4500 | 95 | 32 |
| 0.6% PEG-8000/1.4% PA-4500 | 100 | 32 |
| 2% PA-4500 | 72 | 32 |

As can be seen from the above, mixtures of polyacrylate and polyethylene glycol provide better clay soil removal than either polymer alone.

EXAMPLE II

| Component | Wt. % |
|---|---|
| $C_{14-15}$ monoethoxylate sulfate | 16.8 |
| $C_{12}$ TMAC (trimethylammonium chloride) | 0.9 |
| Synthetic Zeolite A | 17.6 |
| $Na_2CO_3$ | 17.6 |
| Silicate (1.6 r) | 1.8 |
| $Na_2SO_4$ | 17.6 |
| Water, minors, sodium polyacrylate and polyethylene glycol as indicated | Balance |

The above compositions with the indicated amounts of sodium polyacrylate and polyethylene glycol were tested in automatic miniwashers for removal and redeposition of particulate soil (clay). The removal and redeposition of particulate soil was measured with a Hunter reflectometer, and expressed as Final Hunter Whiteness $$\left(\text{defined as } \frac{7L^2 - 40Lb}{700}\right)$$

Clay removal and anti-redeposition benefits for mixtures of polyethylene glycol (MW 8000) and sodium polyacrylate (MW 2000) Conditions: 95° F. (35° C.); 7 grains per gallon.

| PEG-8000 (Wt. %) | PA-2000 (Wt. %) | Redeposition Final Hunter Whiteness Polycotton | Redeposition Final Hunter Whiteness Polyester | Removal Final Hunter Whiteness P/C | Removal Final Hunter Whiteness Cotton |
|---|---|---|---|---|---|
| 0 | 10.9 | 67.7 | 87.7 | 3.4 | −8.1 |
| 2.7 | 8.2 | 87.1 | 100.6 | 11.6 | −1.7 |
| 5.4 | 5.4 | 87.7 | 101.9 | 12.6 | −3.4 |
| 10.9 | 0 | 73.5 | 97.6 | 1.7 | −12.0 |

As can be seen from the above, mixtures of polyacrylate and polyethylene glycol provide better clay soil removal and anti-redeposition benefits than either polymer alone.

EXAMPLE III

| Component | Wt. % |
|---|---|
| $C_{13}$ LAS (linear alkyl benzene sulfonate) | 7.5 |

-continued

| Component | Wt. % |
|---|---|
| $C_{14-15}$ AS (alcohol sulfate) | 7.5 |
| $C_{12}$ TMAC (trimethylammonium chloride) | 1.0 |
| Neodol 23-6.5T ($C_{12-13}E_{6.5}$ topped (alcohol ethoxylate topped) | 2.0 |
| Zeolite A | 24.0 |
| $Na_2CO_3$ | 13.0 |
| 1.6 ratio sodium silicate | 1.0 |
| Trisodium sulfosuccinate | 1.5 |
| Sodium toluene sulfonate | 2.0 |
| DTPA (diethylenetriamine pentaacetate) | 1.0 |
| Brightener 19 | 0.2 |
| $Na_2SO_4$ | 20.0 |
| Water, minors, sodium polyacrylate, polyethylene glycol as indicated | Balance |

The above compositions with the indicated amounts of sodium polyacrylate and polyethylene glycol were tested in automatic miniwashers for removal and redeposition of particulate soil (clay). The results were evaluated with a Hunter reflectometer, and expressed as Final Hunter Whiteness.

Test 1

Clay removal and anti-redeposition benefits for mixtures of polyethylene glycol (MW 8000) and sodium polyacrylate (MW 4,500).

Conditions: 95° F. (35° C.); 7 grains per gallon

| | | Final Hunter Whiteness | | |
|---|---|---|---|---|
| | | Removal | | Redeposition |
| PEG-8000 (Wt. %) | PA-4500 (Wt. %) | Cotton | Polycotton | Polycotton |
| 0 | 2.4 | −17.14 | −3.23 | 103.01 |
| 0.6 | 1.8 | −13.03 | −2.34 | 115.51 |
| 1.2 | 1.2 | −13.70 | −1.22 | 115.81 |
| 1.8 | 0.6 | −13.87 | −2.28 | 114.87 |
| 2.4 | 0 | −18.02 | −5.25 | 109.6 |
| LSD (0.90) | | 3.46 | 2.99 | 3.50 |

Test 2

As test 1, except that sodium acrylate having a weight average molecular weight of 2,000 was used.

| | | Final Hunter Whiteness | | |
|---|---|---|---|---|
| | | Removal | | Redeposition |
| PEG-8000 (Wt. %) | PA-2000 (Wt. %) | Cotton | Polycotton | Polycotton |
| 0 | 2.4 | −15.63 | −6.85 | 103.14 |
| 0.6 | 1.8 | −12.59 | −2.42 | 115.32 |
| 1.2 | 1.2 | −12.52 | −1.10 | 116.04 |
| 1.8 | 0.6 | −11.41 | 0.59 | 114.86 |
| LSD (0.90) | | 3.46 | 2.99 | 3.50 |

As can be seen from the above, mixtures of polyacrylate and polyethylene glycol provide better clay soil removal and anti-redeposition performance than either polymer alone.

What is claimed is:

1. A detergent composition comprising:

(a) from about 5% to about 50% by weight of an organic surfactant selected from the group consisting of anionic, nonionic, zwitterionic, ampholytic and cationic surfactants, and mixtures thereof;

(b) from about 5% to about 80% by weight of a non-phosphorus detergent builder;

(c) from about 1% to about 20% of a mixture of a polyethylene glycol and a polyacrylate, said mixture having a polyethylene glycol:polyacrylate weight ratio of from about 1:10 to about 10:1, said polyethylene glycol having a weight average molecular weight of from about 1,000 to about 50,000, and said polyacrylate having a weight average molecular weight of from about 1,000 to about 20,000.

2. The composition of claim 1 wherein the organic surfactant comprises an anionic surfactant selected from the group consisting of alkali metal salts of $C_{11-13}$ alkylbenzene sulfonates, $C_{14-18}$ alkyl sulfates, $C_{14-18}$ alkyl polyethoxyl sulfates containing from about 1 to about 4 moles of ethylene oxide, and mixtures thereof.

3. The composition of claim 1 wherein the non-phosphate detergent builder is selected from the group consisting of zeolites, carbonates, or mixtures thereof.

4. The composition of claim 1 wherein the non-phosphorus detergent builder comprises from about 1% to about 4% by weight of an alkali metal silicate having a molar ratio of from about 1.6 to about 2.4.

5. The composition of claim 1 comprising from about 1.5% to about 3% of the mixture of polyethylene glycol and polyacrylate.

6. The composition of claim 1 wherein the polyethylene glycol and the polyacrylate are present in a weight ratio of from about 1:3 to about 3:1.

7. The composition of claim 1 wherein the polyethylene glycol has a weight average molecular weight of from about 5,000 to about 20,000.

8. The composition of claim 1 wherein the polyacrylate is a salt of a homopolymer of acrylic acid, hydroxyacrylic acid or methacrylic acid, or a copolymer thereof containing at least about 80% by weight of units derived from said acids.

9. The composition of claim 8 wherein the polyacrylate has a weight average molecular weight of from about 3,000 to about 15,000.

10. The composition of claim 8 wherein the polyacrylate has a weight average molecular weight of from about 3,000 to about 8,000.

11. The composition of claim 8 comprising from about 1.5% to about 10% of the mixture of polyacrylate and polyethylene glycol.

12. The composition of claim 9 wherein the polyacrylate is sodium polyacrylate.

13. The composition of claim 2 comprising from about 10% to about 30% by weight of the organic surfactant; from about 15% to about 60% by weight of non-phosphate detergent builder salt comprising hydrated sodium Zeolite A, carbonate, nitrilotriacetate, or mixtures thereof.

14. The composition of claim 13 comprising from about 1.5% to about 3% of a mixture of a polyethylene glycol and sodium polyacrylate, said mixture having a polyethylene glycol:sodium polyacrylate weight ratio of from about 1:3 to about 3:1, said polyethylene glycol having a weight average molecular weight of from about 5,000 to about 20,000, and said sodium polyacrylate having a weight average molecular weight of from about 3,000 to about 8,000.

15. The composition of claim 14 prepared by spray-drying an aqueous slurry of the components.

16. The composition of claim 15 comprising from about 10% to about 30% by weight of aluminosilicate ion exchange material of the formula $Na_{12}[(AlO_2)_{11}.(SiO_2).]xH_2O$, wherein x is from about 20 to about 30.

* * * * *